US009190195B2

(12) United States Patent
Kino

(10) Patent No.: US 9,190,195 B2
(45) Date of Patent: Nov. 17, 2015

(54) FE-GROUP-BASED SOFT MAGNETIC POWDER

(75) Inventor: Yasushi Kino, Toyokawa (JP)

(73) Assignee: SINTOKOGIO, LTD., Nagoya-Shi (JP)

( * ) Notice: Subject to any disclaimer, the term of this patent is extended or adjusted under 35 U.S.C. 154(b) by 52 days.

(21) Appl. No.: 13/702,379

(22) PCT Filed: Jun. 7, 2011

(86) PCT No.: PCT/JP2011/063057

§ 371 (c)(1),
(2), (4) Date: Dec. 6, 2012

(87) PCT Pub. No.: WO2011/155494

PCT Pub. Date: Dec. 15, 2011

(65) Prior Publication Data

US 2013/0076477 A1 Mar. 28, 2013

(30) Foreign Application Priority Data

Jun. 9, 2010 (JP) ..... 2010-131667

(51) Int. Cl.
*C22C 38/02* (2006.01)
*C22C 38/18* (2006.01)
(Continued)

(52) U.S. Cl.
CPC *H01F 1/01* (2013.01); *B22F 9/082* (2013.01); *C22C 1/02* (2013.01); *C22C 38/02* (2013.01); *C22C 38/08* (2013.01); *C22C 38/10* (2013.01); *C22C 38/12* (2013.01); *C22C 38/26* (2013.01); *C22C 38/34* (2013.01); *H01F 1/20* (2013.01); *H01F 41/0246* (2013.01); *B22F 2009/0828* (2013.01)

(58) Field of Classification Search
CPC .... C22C 38/02; C22C 2202/02; C22C 38/18; H01F 1/01
USPC ..... 148/104, 300
See application file for complete search history.

(56) References Cited

U.S. PATENT DOCUMENTS

2009/0025830 A1 1/2009 Uozumi et al.
2009/0295518 A1 * 12/2009 Nishi et al. ..... 335/296

FOREIGN PATENT DOCUMENTS

EP 383035 A2 * 8/1990
JP 3-68743 3/1991
JP 4-9401 1/1992
JP H07-074410 B * 8/1995
(Continued)

OTHER PUBLICATIONS

International Search Report; Appln. PCT JP 2011/063057; Sep. 13, 2011.

*Primary Examiner* — Roy King
*Assistant Examiner* — Xiaowei Su
(74) *Attorney, Agent, or Firm* — Finnegan, Henderson, Farabow, Garrett & Dunner, L.L.P.

(57) ABSTRACT

The present invention provides a Fe-group-based soft magnetic powder that is used for the pressed powder magnetic cores for a choke coil, reactor coil, etc., and that has a higher magnetic permeability. At least one selected from Fe, Co, or Ni that is generally used is used as the main component of the Fe-group-based alloy (iron-based alloy) soft magnetic powder. The soft magnetic powder is produced by adding a small amount (0.05-4 wt %) of Nb, V, Ta, Ti, Mo, or W, to the molten metal and by means of an inexpensive method such as the water-atomizing method.

8 Claims, 2 Drawing Sheets

(51) Int. Cl.

| | |
|---|---|
| ***H01F 1/01*** | (2006.01) |
| ***C22C 1/02*** | (2006.01) |
| ***C22C 38/08*** | (2006.01) |
| ***C22C 38/10*** | (2006.01) |
| ***C22C 38/12*** | (2006.01) |
| ***C22C 38/26*** | (2006.01) |
| ***C22C 38/34*** | (2006.01) |
| ***H01F 1/20*** | (2006.01) |
| ***H01F 41/02*** | (2006.01) |
| ***B22F 9/08*** | (2006.01) |

(56) References Cited

FOREIGN PATENT DOCUMENTS

| | | | |
|---|---|---|---|
| JP | 2001-226753 | | 8/2001 |
| JP | 2003-060175 | | 2/2003 |
| JP | 2006-219714 | | 8/2006 |
| JP | 2006-219714 A | * | 8/2006 |
| JP | 2008-109080 | | 5/2008 |
| JP | 2009-088496 | | 4/2009 |
| JP | 2009-088502 | | 4/2009 |
| JP | 2009-088502 A | * | 4/2009 |

* cited by examiner

FE-GROUP-BASED SOFT MAGNETIC POWDER

TECHNICAL FIELD

This invention relates to Fe-group-based soft magnetic powder that can easily attain superior soft magnetic properties that are required of a pressed powder magnetic core, as, for example, in a choke coil, reactor coil, etc.

BACKGROUND

Recently, pressed powder magnetic cores, as, for example, in a choke coil, reactor coil, etc., are often adopted in an environment where the choke coil, reactor coil, etc., are used under a high current, or where they are used in a high-frequency range or in a limited space. So, also the soft magnetic powder that is used for such a choke coil, reactor coil, etc., must have superior soft magnetic property if it may be used under a high current, or at a higher frequency, or will be suitably used in a choke coil, reactor, coil, etc., that have limited sizes.

In general, soft magnetic powder that is used as a pressed powder magnetic core should have a high saturation magnetic flux density, high magnetic permeability, and a low core loss, because the pressed powder magnetic cores are often used under a high current. Also, it is preferred that the core be highly resistive in light of achieving a low current loss.

However, usually it is difficult to manufacture a soft magnetic powder that has all these characteristics. So, depending on the need, different soft magnetic powders are used, such as a) an oxidized soft magnetic powder (Ferrite), b) amorphous Fe-group-based soft magnetic powder, and c) crystalline Fe-group-based soft magnetic powder (Metal Alloy) (for example, see Patent Documents 1 and 2).

a) The oxidized soft magnetic powder is highly-resistive and thus has a low core loss. But it is unsuitable for use under a high current because it has a low saturation magnetic flux density.
b) Amorphous Fe-group-based soft magnetic powder has a superior magnetic property. But due to the structure of the powder composition the amorphous Fe-group-based soft magnetic powder has very high hardness of the powder and it is hard to press it into a desired shape. Also, it does not have a sufficient saturation magnetic flux density, so that it cannot be used as a pressed powder magnetic core of a small size.
c) Crystalline Fe-group-based soft magnetic powder has a high saturation magnetic flux density and also has comparatively lower hardness of the powder. So, it can be pressed into a powder magnetic core having a low core loss if insulation of the surface of the powder is secured, for example, by using resin, etc. Also, it is suitable for use as a pressed powder magnetic core of a small size that is used under a high current and in a high-frequency range.

It is generally recognized that finer Fe-group-based alloy soft magnetic powder is suitably used in an environment of a high-frequency range or for obtaining a low core loss.

However, it needs a higher level of technology to press finer powder into a desired shape or it needs more resin, etc., to obtain a sufficient insulation between the fine powders. For this reason there is a problem in that the high permeability property (magnetic property) that the Fe-group-based alloy soft magnetic powder itself normally has cannot be utilized because of the lowering of the magnetic permeability of the pressed powder magnetic core itself due to a decrease in the density of the pressed powder magnetic core. Patent Documents 1 and 2 disclose coating the surface of the powder by oxidation. But the coating by oxidizing makes the manufacturing process complex.

For these reasons, even by using the conventional Fe-group-based soft magnetic powder, if higher magnetic permeability is obtained without increasing the core loss, the pressed powder magnetic core that has lower density can be used under a high current or in a high-frequency range. Thus minimizing the size of the pressed powder magnetic core and lowering the core loss can be achieved without using a high-level pressing technology.

Patent Documents 1 and 2 disclose manufacturing the soft magnetic powder by a water atomizing process, etc., as in the present invention. They disclose using an adjunct component selected from Si, Al, and Cr and also disclose that it is possible to add the metals of groups IV-VI as a small-amount adjunct component (Patent Document 1, Paragraph 0053, and Patent Document 2, Paragraphs 0021 and 0044). But the metals of groups IV-VI as small-amount adjunct components (transition metals whose d-orbitals are less than half filled) are shown as mere examples, just as are Mn, Co, Ni, Cu, Ga, Ge, Ru, Rh, etc., of the metals of groups VII-XI (transition metals whose d-orbitals are more than half filled) and just as is B (boron). Further, neither Patent Document 1 nor 2 includes any description that implies that the small-amount adjunct component should be added to improve the magnetic property (particularly to attain the high magnetic permeability) (Patent Document 1, Paragraph 0053, and Patent Document 2, Paragraph 0044). Paragraph 0044 of Patent Document 2 says that the small-amount adjunct component that is added is preferably 1 wt % or less.

Although it does not affect the patentability of the present invention, there are the prior-art publications, i.e., Patent Documents 3-5, that refer to the amorphous Fe-group-based soft magnetic powder, to which a small amount of the metals of groups IV-VI is added.

The metals of groups IV-VI denoted by M in the compositional formula $Fe_{100-a-b-x-y-z-w-t}CO_aNi_bM_xP_yC_zB_wSi_t$ of Patent Document 3 are shown as mere examples, like Pd, Pt, Au, etc., of the metals of groups X-XI given in Patent Documents 1 and 2. Further, in Patent Document 3 the metals of groups IV-VI are added to improve the corrosion resistance of the powder by a passivated oxide coating being formed (Paragraph 0024). Also, the description in that paragraph stating that "the amount of M that is added is preferably 0-3 atom % if the magnetic property and corrosion resistance are considered" should mean, when the preceding paragraph is considered, that Nb does not increase the magnetic property, but that rather it would cause the magnetic property to be lowered if it were added in a large amount.

The metals of groups IV-VI denoted by M' in the compositional formula $T_{100-x-y}R_xM_yM'_z$ of Patent Document 4 are shown as mere examples, like the other metals of groups VII-XI, and further, like non-metals or typical metals like P, Al, Sb, etc. Also, in Patent Document 4, by adding M', the corrosion resistance is expected to improve. Also, Patent Document 4 says that the amount to be added is preferably in the range of 0-30%, more preferably 0-20% (Patent Document 4, page 9, the lower part, the second paragraph). That is, the addition of M' as stated in Patent Document 4 does not suggest that one should add the metals of groups IV-VI in a small amount of 4% or less as is disclosed in the present invention.

Similarly, in Patent Document 5, also the metals of groups IV-VI denoted by M' in compositional formula $T_{100-x-y}R_xM_yM'_z$ are given only as mere examples, like the metals of groups VII-XI and like the typical metals, such as Zn, Ga, etc.

Paragraph 0032 of Patent Document 5 says, "Addition of element M' has an effect where the coercive force of a microcrystallite alloy is lowered. However, if the content of the element M' is too large, the magnetization is lowered. So, the ratio z of element M' in the composition should be 0 at %≤z≤10 at %, preferably 0.5 at %≤z≤4 at %." This statement, like one in Patent Document 3, is considered to imply that element M' contributes to lowering a core loss by minimizing the coercive force of soft magnetic, but that it does not contribute to increasing the magnetic permeability (magnetization).

RELATED DOCUMENTS

Patent Documents

Patent document 1: Japanese Laid-open Publication No. 2009-088496

Patent document 2: Japanese Laid-open Publication No. 2009-088502

Patent document 3: Japanese Laid-open Publication No. 2008-109080

Patent document 4: Japanese Laid-open Publication No. 2003-060175

Patent document 5: Japanese Laid-open Publication No. 2001-226753

SUMMARY OF THE INVENTION

Problem to be Solved by the Invention

In view of the above problems, the present invention aims to provide crystalline Fe-group-based soft magnetic powder that enables, with an addition of a small amount of an element, a pressed powder magnetic core to have a higher magnetic permeability, and also to easily manufacture, from the magnetic powder, a pressed powder magnetic core that is not affected by an increase of a core loss.

Means to Solve Problem

To solve the problems, based on the findings that a pressed powder magnetic core made from soft magnetic powder that includes an addition of a small amount of Nb, etc., has an increased high permeability but does not increase a core loss, the inventor of the present invention has arrived at the invention of Fe-group-based soft magnetic powder that has the following composition:

The basic composition of the crystalline Fe-group-based soft magnetic powder is expressed by the compositional formula $T_{100-x-y}M_xM'_y$ (where T is the main component that is at least one element selected from the Fe group; M is a component that improves the magnetic permeability; M' is a component that gives corrosion resistance; x is 0-15 at %; y is 0-15 at %; and x+y is 0-25 at %), wherein a trace component that modifies magnetic property, which component is at least one transition metal selected from groups IV-VI, is comprised in 0.05-4.0 weight parts based on 100 weight parts of the entire composition expressed by the compositional formula.

If the trace component that modifies magnetic property is incorporated in the compositional formula and is specified by "at %" (atomic weight %) in the compositional formula, the compositional formula is shown as follows:

The crystalline Fe-group-based soft magnetic powder has a composition wherein it is expressed by the compositional formula $T_{100-x-y}M_xM'_yN_z$ (where T is the main component that is at least one element selected from the Fe group; M is a component that improves magnetic permeability; M' is a component that gives corrosion resistance; N is a trace component that modifies magnetic property), and wherein the trace component that modifies magnetic property is at least one transition metal selected from groups IV-VI, and x is 0-15 at %; y is 0-15 at %; x+y is 0-25 at %; and z is 0.015-2.4 at %.

The component that improves magnetic permeability M is at least one selected from Si, Ni, and Co; the component that gives corrosion resistance M' is either Cr or Al; and in one embodiment T is Fe, M is Si, and M' is Cr, and x is 2-10 at %; y is 2-10 at %; and x+y is 4-15 at %.

Effect of the Invention

The pressed powder magnetic core that is made from the Fe-group-based soft magnetic powder having the above composition and by the powder being pressed can have a higher magnetic permeability, and it is not affected by the increase of the core loss.

Also, it need not quickly quench the powder when it is manufactured by a water atomizing process, etc., because the powder is crystalline.

Further, to give a high magnetic permeability to the pressed powder magnetic core is easy, so that to use high-pressure pressing is not necessary when manufacturing a pressed powder magnetic core. As a result, insulation is less likely to break down.

Needless to say, the powder need not have an oxide layer formed on the soft magnetic powder, unlike the powders in Patent Documents 1 and 2.

EMBODIMENTS OF THE INVENTION

Figure 1:
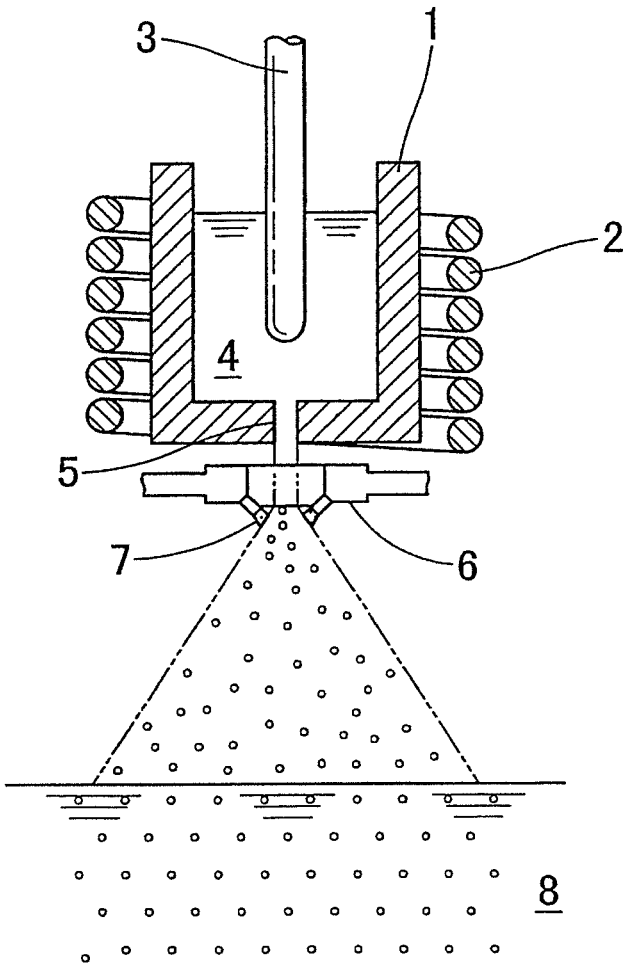
FIG. 1 is a schematic cross-sectional view of equipment for the water atomization suitable for manufacturing the soft magnetic powder of the present invention.
Figure 2:
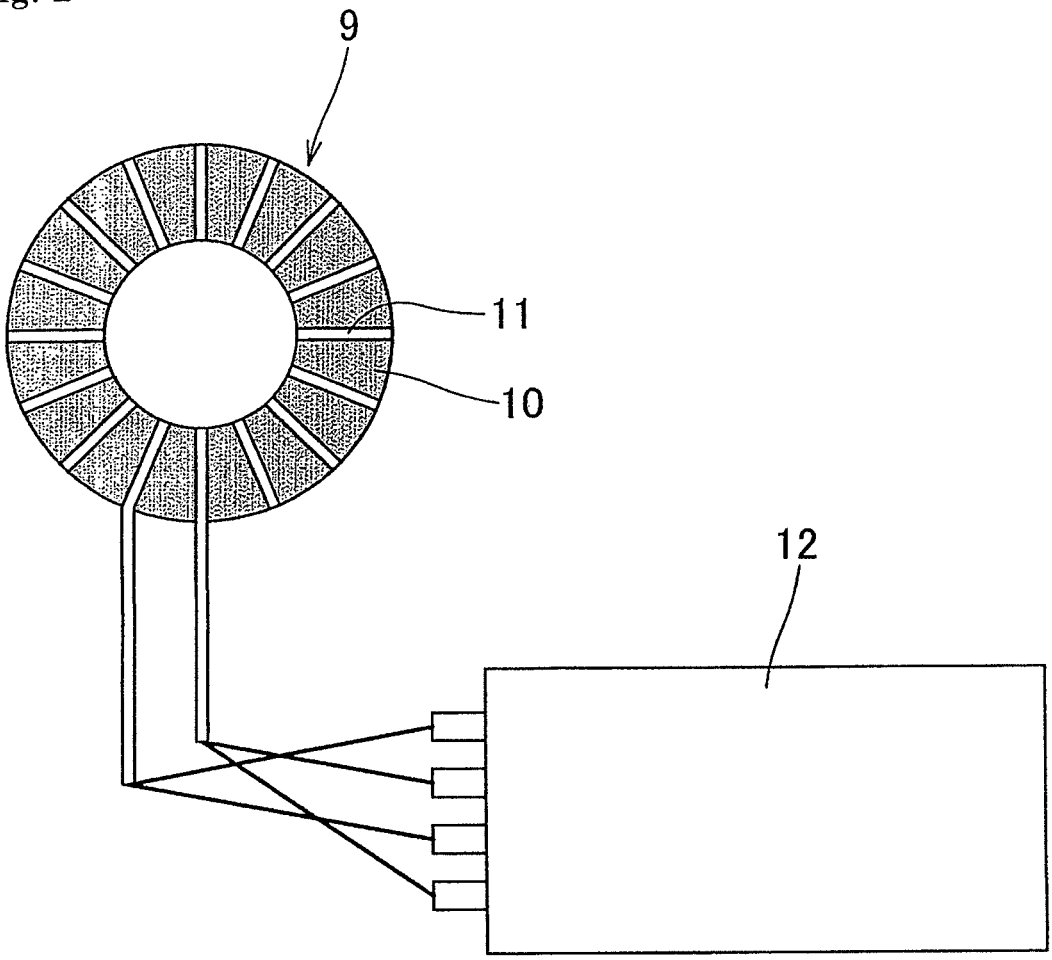
FIG. 2 is a schematic diagram of a method of measuring the magnetic permeability and the core loss of the pressed powder magnetic core that is manufactured from the soft magnetic powder of the present invention.

Below the embodiments of the present invention are explained.

The soft magnetic powder of the present invention is characterized in that the basic composition of the soft magnetic powder is expressed by the compositional formula $T_{100-x-y}M_xM'_y$ (where T is the main component, which is at least one element selected from the Fe group; M is a component that improves magnetic permeability; M' is a component that gives corrosion resistance; x is 0-15 at %; y is 0-15 at %; and x+y is 0-25 at %).

T is typically Fe. But all or more than half of the Fe can be substituted by Co, Ni, etc. For example, the soft magnetic powder whose Fe is substituted by 80 at % by Co or by 50 at % by Ni is sold on the market.

The component that improves magnetic permeability denoted by M can include Si, Co, and Ni (however, only when Co or Ni is not the main component). But, Si, which is not expensive and can increase the magnetic permeability to a relatively high degree, is preferred. If Si is added, x should be x: 2-10 at %, more preferably x: 3-8 at %. If too much Si is added, the powder itself becomes brittle and hard to be pressed. Also, powder having too much Si tends to give an unfavourable effect to the shape of the powder, thereby to likely cause problems in the magnetic property of the pressed powder magnetic core and in the formability of the pressed powder magnetic core.

The component that gives corrosion resistance denoted by M' can be Cr, Mn, Al, Cu, etc. Among these, Cr, which gives great corrosion resistance, is preferred (Cr also increases the resistivity). This is because of the following reasons: If the pressed powder magnetic core is used where higher reliability is required, such as in electronic components, the powder that is highly corrosion resistant, for example, against humidity, etc., has a strong demand.

If M' is Cr, $1 \leq y \leq 10$ at %, preferably $2 \leq y \leq 8$ at %. If too much Cr is included, the magnetic permeability of the pressed powder magnetic core often decreases (the magnetic property is affected).

In this embodiment of the present invention, further, a small amount of at least one trace component that modifies magnetic property (adjunct component that improves magnetic permeability) and that is selected from the transition metals of groups IV-VI is added to the soft magnetic powder. The transition metals of groups IV-VI are considered to suppress magnetic anisotropy and internal distortion that cause the magnetic permeability to decrease.

Namely, the transition metals of groups IV-VI, whose d-orbitals are less than half filled (the atomic radii are relatively small), if added in a small amount to the crystal grain boundary, are considered to lower the magnetic anisotropy (because of an effect where the directions of spins are adjusted). Also, they are considered to reduce the internal distortion if a small amount of the transition metals of groups IV-VI is added to the crystal grain boundary. Generally, it is known that substantial internal distortion occurs within the soft magnetic powder that is manufactured by a manufacturing method, such as an atomizing method, that has a step of relatively quick quenching The addition of the small amount of the trace component should mean to add 0.05-4.0 weight parts of the transition metals of IV-VI groups, preferably 0.08-3.5 weight parts, more preferably 0.2-0.6 weight parts in weight, based on the 100 weight parts of the entire basic composition that is expressed by the compositional formula.

If the amount added of the trace component that modifies magnetic property were too small, the magnetic permeability would not improve. If the amount to be added were too much, a saturation magnetic value that is normally expected would be lowered. This is because the other adjunct components are the basic components that are essential to greatly increase the magnetic permeability and corrosion resistance or not to increase the core loss. That is, the trace component that modifies magnetic property mainly improves magnetic property (magnetic permeability). But, to add it in large quantity would increase the cost and also would lower the saturation magnetic value, which should be avoided.

For the Fe-group-based soft magnetic powder of the present invention, the amount of the trace component that modifies magnetic property and that is added is selected within the scope as stated above, based on the compositional formula ($T_{100-x-y}M_xM'_yN_z$) that incorporates the trace component that modifies magnetic property. Thus z is 0.15-2.4 at %, preferably 0.10-0.40 at %. z is a range that is determined based on any magnetic core loss of the cores that can be manufactured by any possible manufacturing method. As z is small, x and y have ranges that are substantially the same as those stated above.

Among the trace components that modify magnetic permeability, which components are selected from the transition metals of groups IV-VI, Nb is most preferred. Mo and W, which are positioned adjacent to Nb in the periodic table and which belong to the group that is the same as group V, i.e., the group for Nb, and have the same oxidation number (+5) as Nb, and Ti, which has an atomic radius close to that of Nb, are preferred.

The soft magnetic powder of the present invention is crystalline and not amorphous and it need not be quickly quenched. Thus it can be manufactured by a general-purpose water-atomizing process or gas-atomizing process.

The water atomizing process, which requires less money, is recommended. The shapes of the powders that are obtained are preferably spherical from the viewpoint of the magnetic property.

Below a method of manufacturing the soft magnetic powder of the present invention by the water-atomizing process as shown in FIG. 1 is explained. In FIG. 1 the following elements are denoted by the respective numbers given after the elements: melting furnace 1, induction heating coil 2, stopper for melting 3, raw material for melting 4, orifice 5, nozzle for atomizing 6, water screen 7, and water 8.

The raw material (mixture of alloy components) that was prepared so as to have the predetermined composition, is heated above the melting point and melted in the melting furnace 1. Next, by opening the stopper for melting 3, molten metal drops through the orifice 5 for the molten metal. The orifice is provided at the bottom of the melting furnace 1. By quickly quenching and solidifying the raw material that was melted, using the water screen formed by the water sprayed from the nozzle for atomizing 6 that is provided below the lower part of the melting furnace, powder having particles of spherical shapes can be obtained cheaply. Then the powders are collected, dried, and classified and the desired soft magnetic powders are obtained.

The particles diameter of the powders (sizes of particles) have diameters of 0.5-100 μm, preferably 0.5-75 μm, more preferably 1-50 μm. If the diameters of the particles are small, the quantity of the binders, such as resin, etc., that secures the insulation of the pressed powder magnetic core, increases, and reduces the relative density. As a result the high magnetic permeability is hard to obtain. However, if the diameters of the particles are great, just a small amount of binders, such as resins, etc., can secure the insulation of the pressed powder magnetic core. But it is hard to achieve the lower core loss for the pressed powder magnetic core having fine particles (the particles having small diameters).

The pressed powder magnetic core can be produced from the soft magnetic powder of 100 weight parts mixed with the binder of 1-10 weight parts by means of a known method, such as pressing, etc. If the quantity of the binder is too large, the high magnetic permeability is hard to obtain, as explained above. However, if the quantity of the binder is too small, the strength required for a magnetic core cannot be obtained. Also, as the binders, the organic binders such as silicone resin, epoxy resin, phenolic resin, polyamide resin, polyimide resin, polyphenylene-sulfide resin, and the inorganic binders, such as a phosphate such as magnesium phosphate, calcium phosphate, zinc phosphate, manganese phosphate, and cadmium phosphate, and a silicate such as sodium silicate (water glass), can be freely used, in so far as appropriate strength for the magnet core can be obtained and the magnetic permeability is not impaired.

EXAMPLES

Below are explained experiments that were carried out to see the effects of the present inventions.

First, the mixtures of materials that were prepared to have the compositions given in Tables 1-3 were melted with a high-frequency induction furnace and the soft magnetic powder was obtained by the water-atomizing method. The conditions for manufacturing the test samples of the soft magnetic powder were as follows:

Conditions for the water-atomizing
water pressure 100 MPa
quantity of water 100 L/min
temperature of water 20° C.
diameter of orifice 4 mm
temperature of melted raw material 1,800° C.

Next, the soft magnetic powder that was produced was collected and dried with a vibrating vacuum drier (Chuo Kakoki Co., Ltd.: UV-60). The drying was carried out in an atmosphere of reduced pressure, so that the soft magnetic powder could be dried in a hypoxic atmosphere, i.e., one having less oxygen than at atmospheric pressure. Also, the drying can be carried out in a shorter time and at a lower temperature. Further, if the soft magnetic powder is vibrated during the drying, it can be dried in a much shorter time, thereby preventing the aggregation or oxidization of the powder from occurring. In the present example, the temperature for drying was at 100° C., the pressure within the chamber for drying was at −0.1 MPa (gauge pressure), and the period for drying was 60 min.

Then the soft magnetic powder that was obtained was classified by an air classifier (Nisshin Engineering Inc.: Turbo Classifier) and the powders having particles of the desired average diameters (50 μm, 10 μm, and 1 μm) were obtained. An analyzer of particle-size distribution using laser diffractometry (Shimadzu Corporation: SALD-2100) was used to measure the particle-size distribution of the powders.

A mixture was obtained by mixing the produced power having the specific particle-size distribution with an epoxy resin (binder) and toluene (organic solvent). The epoxy resin that was added was in 3 wt % and 5 wt % of the soft magnetic powder.

The mixture thus obtained was heated and dried at a temperature of 80° C. for 30 minutes and blocks of dried substance were obtained. Then the dried substance was sifted by a sieve having apertures of 200 μm and powder-mixture (pellets) was produced.

The powder was filled into a forming die and an object formed by the die (pressed powder magnetic core) 10 was obtained Conditions for forming:
forming method: press forming
shape of formed object: ring shape
size of formed object: OD 13 mm, ID 8 mm, thickness 6 mm
pressure for forming: 5 t/cm3 (490 MPa)

Conditions for manufacturing coil:

A choke coil 9 was manufactured by winding a conductive wire 11 around the formed object 10 under the following conditions:

material of conductive wire: Cu
diameter of conductive wire: 0.2 mm
number of windings: primary 45 turns, secondary 45 turns Conditions for measurements and evaluation:

The choke coil manufactured under the above conditions was measured by a measuring device 12 under the following conditions and the results were evaluated:

measuring device: device for measuring AC magnetic property (Iwatsu Test Instruments Corp., B-H analyzer SY8258)
frequency for the measurements: 200 kHZ
maximum flux density: 50 mT The following are the results of the evaluation:

(1) Table 1 shows the results where Nb is added to Fe powder material, Tables 2 (A) and 2 (B) show the results where Nb is added to Fe—Si powder material, and Tables 3 (A) and 3 (B) show the results where Nb is added to Fe—Si—Cr powder material. Table 4 shows the results where a component that improves magnetic permeability M that is selected from Si, Ni, and Co, and a component that gives corrosion resistance M' that is selected from Cr and Al, are added to the Fe powder material, to which Nb is added. Table 5 shows the results where the trace component that modifies a magnetic property selected from Nb, V, Ti, Mo, and W is added to each Fe powder material, each Fe—Si powder material, and each Fe—Si—Cr powder material.

From Tables 1-5, the following can be observed.

For all powders having any composition or any particle size, the addition of the trace component that modifies magnetic property decreases the core loss and improves the magnetic permeability. Particularly, the addition of Nb produces more conspicuous results.

For these reasons the size of the pressed powder magnetic core can be minimized. Namely, the low-core loss can be realized such that a small size magnetic core that can be used in a high-frequency range can be manufactured without using fine powder where it is hard to obtain a high green density. Also, in light of the mechanical characteristics of the pressed powder magnetic core, the quantity of the resins can be increased.

TABLE 1

| | basic component (at %) Fe | additive (wt %) Nb | size of particle (μm) | quantity resin (wt %) | magnetic permeability | core loss (kw/m$^3$) |
|---|---|---|---|---|---|---|
| Comparative Examples 1-1 | 100 | 0 | 50 | 3 | 14 | 6800 |
| Examples 1-1 | 100 | 0.1 | 50 | 3 | 19 | 6500 |
| Examples 1-2 | 100 | 0.3 | 50 | 3 | 22 | 6450 |
| Examples 1-3 | 100 | 3 | 50 | 3 | 26 | 6450 |
| Comparative Examples 1-2 | 100 | 0 | 50 | 5 | 13 | 6600 |
| Examples 1-4 | 100 | 0.1 | 50 | 5 | 18 | 6200 |
| Examples 1-5 | 100 | 0.3 | 50 | 5 | 22 | 6200 |
| Examples 1-6 | 100 | 3 | 50 | 5 | 24 | 6200 |
| Comparative Examples 1-3 | 100 | 0 | 10 | 3 | 13 | 4200 |
| Examples 1-7 | 100 | 0.1 | 10 | 3 | 18 | 4050 |
| Examples 1-8 | 100 | 0.3 | 10 | 3 | 21 | 4050 |
| Examples 1-9 | 100 | 3 | 10 | 3 | 25 | 4050 |

TABLE 1-continued

| | basic component (at %) Fe | additive (wt %) Nb | size of particle (μm) | quantity resin (wt %) | magnetic permeability | core loss (kw/m$^3$) |
|---|---|---|---|---|---|---|
| Comparative Examples 1-4 | 100 | 0 | 10 | 5 | 11 | 4000 |
| Examples 1-10 | 100 | 0.1 | 10 | 5 | 15 | 3850 |
| Examples 1-11 | 100 | 0.3 | 10 | 5 | 17 | 3800 |
| Examples 1-12 | 100 | 3 | 10 | 5 | 20 | 3820 |
| Comparative Examples 1-5 | 100 | 0 | 1 | 3 | 9 | 2700 |
| Examples 1-13 | 100 | 0.1 | 1 | 3 | 17 | 2200 |
| Examples 1-14 | 100 | 0.3 | 1 | 3 | 21 | 2100 |
| Examples 1-15 | 100 | 3 | 1 | 3 | 25 | 2100 |
| Comparative Examples 1-6 | 100 | 0 | 1 | 5 | 8 | 2500 |
| Examples 1-16 | 100 | 0.1 | 1 | 5 | 16 | 2000 |
| Examples 1-17 | 100 | 0.3 | 1 | 5 | 20 | 1980 |
| Examples 1-18 | 100 | 3 | 1 | 5 | 24 | 1800 |

TABLE 2(A)

| | basic component (at %) | | additive (wt %) | size of particle | quantity resin | magnetic | core loss |
|---|---|---|---|---|---|---|---|
| | Fe | Si | Nb | (μm) | (wt %) | permeability | (kw/m$^3$) |
| Comparative Examples 2-1 | remainder | 6 | 0 | 50 | 3 | 30 | 4200 |
| Examples 2-1 | remainder | 6 | 0.1 | 50 | 3 | 36 | 4000 |
| Examples 2-2 | remainder | 6 | 0.3 | 50 | 3 | 42 | 3980 |
| Examples 2-3 | remainder | 6 | 3 | 50 | 3 | 45 | 3960 |
| Comparative Examples 2-2 | remainder | 6 | 0 | 50 | 5 | 24 | 3900 |
| Examples 2-4 | remainder | 6 | 0.1 | 50 | 5 | 33 | 3600 |
| Examples 2-5 | remainder | 6 | 0.3 | 50 | 5 | 40 | 3400 |
| Examples 2-6 | remainder | 6 | 3 | 50 | 5 | 43 | 3300 |
| Comparative Examples 2-3 | remainder | 6 | 0 | 10 | 3 | 20 | 2400 |
| Examples 2-7 | remainder | 6 | 0.1 | 10 | 3 | 24 | 2300 |
| Examples 2-8 | remainder | 6 | 0.3 | 10 | 3 | 30 | 2000 |
| Examples 2-9 | remainder | 6 | 3 | 10 | 3 | 33 | 1960 |
| Comparative Examples 2-4 | remainder | 6 | 0 | 10 | 5 | 18 | 3000 |
| Examples 2-10 | remainder | 6 | 0.1 | 10 | 5 | 23 | 2200 |
| Examples 2-11 | remainder | 6 | 0.3 | 10 | 5 | 29 | 1980 |
| Examples 2-12 | remainder | 6 | 3 | 10 | 5 | 30 | 1900 |
| Comparative Examples 2-5 | remainder | 6 | 0 | 1 | 3 | 13 | 1600 |
| Examples 2-13 | remainder | 6 | 0.1 | 1 | 3 | 16 | 1400 |
| Examples 2-14 | remainder | 6 | 0.3 | 1 | 3 | 22 | 1200 |
| Examples 2-15 | remainder | 6 | 3 | 1 | 3 | 25 | 1100 |
| Comparative Examples 2-6 | remainder | 6 | 0 | 1 | 5 | 10 | 1500 |
| Examples 2-16 | remainder | 6 | 0.1 | 1 | 5 | 15 | 1230 |
| Examples 2-17 | remainder | 6 | 0.3 | 1 | 5 | 21 | 1060 |
| Examples 2-18 | remainder | 6 | 3 | 1 | 5 | 23 | 1020 |

TABLE 2 (B)

| | | basic component (at %) | | additive (wt %) | size of particle | quantity resin | magnetic | core loss |
|---|---|---|---|---|---|---|---|---|
| | | Fe | Si | Nb | (μm) | (wt %) | permeability | (kw/m$^3$) |
| Comparative Examples | 2-7 | remainder | 12 | 0 | 50 | 3 | 36 | 3800 |
| Examples | 2-19 | remainder | 12 | 0.1 | 50 | 3 | 42 | 3500 |
| Examples | 2-20 | remainder | 12 | 0.3 | 50 | 3 | 49 | 3160 |
| Examples | 2-21 | remainder | 12 | 3 | 50 | 3 | 50 | 3100 |
| Comparative Examples | 2-8 | remainder | 12 | 0 | 50 | 5 | 33 | 3700 |
| Examples | 2-22 | remainder | 12 | 0.1 | 50 | 5 | 40 | 3300 |

TABLE 2 (B)-continued

| | | basic component (at %) | | | additive (wt %) | size of particle | quantity resin | magnetic | core loss |
|---|---|---|---|---|---|---|---|---|---|
| | | Fe | Si | Nb | | (μm) | (wt %) | permeability | (kw/m$^3$) |
| Examples | 2-23 | remainder | 12 | 0.3 | | 50 | 5 | 47 | 3070 |
| Examples | 2-24 | remainder | 12 | 3 | | 50 | 5 | 49 | 3000 |
| Comparative Examples | 2-9 | remainder | 12 | 0 | | 10 | 3 | 24 | 3200 |
| Examples | 2-25 | remainder | 12 | 0.1 | | 10 | 3 | 26 | 2800 |
| Examples | 2-26 | remainder | 12 | 0.3 | | 10 | 3 | 33 | 2200 |
| Examples | 2-27 | remainder | 12 | 3 | | 10 | 3 | 34 | 2000 |
| Comparative Examples | 2-10 | remainder | 12 | 0 | | 10 | 5 | 22 | 3160 |
| Examples | 2-28 | remainder | 12 | 0.1 | | 10 | 5 | 25 | 2600 |
| Examples | 2-29 | remainder | 12 | 0.3 | | 10 | 5 | 33 | 2050 |
| Examples | 2-30 | remainder | 12 | 3 | | 10 | 5 | 33 | 1980 |
| Comparative Examples | 2-11 | remainder | 12 | 0 | | 1 | 3 | 15 | 1800 |
| Examples | 2-31 | remainder | 12 | 0.1 | | 1 | 3 | 18 | 1400 |
| Examples | 2-32 | remainder | 12 | 0.3 | | 1 | 3 | 25 | 1200 |
| Examples | 2-33 | remainder | 12 | 3 | | 1 | 3 | 28 | 1160 |
| Comparative Examples | 2-12 | remainder | 12 | 0 | | 1 | 5 | 12 | 1740 |
| Examples | 2-34 | remainder | 12 | 0.1 | | 1 | 5 | 17 | 1260 |
| Examples | 2-35 | remainder | 12 | 0.3 | | 1 | 5 | 24 | 1060 |
| Examples | 2-36 | remainder | 12 | 3 | | 1 | 5 | 25 | 1040 |

TABLE 3(A)

| | basic component (at %) | | | additive (wt %) | size of particle | quantity resin | magnetic | core loss |
|---|---|---|---|---|---|---|---|---|
| | Fe | Si | Cr | Nb | (μm) | (wt %) | permeability | (kw/m$^3$) |
| Comparative Examples 3-1 | remainder | 6.7 | 4.6 | 0 | 50 | 3 | 30 | 3100 |
| Examples 3-1 | remainder | 6.7 | 4.6 | 0.1 | 50 | 3 | 32 | 2950 |
| Examples 3-2 | remainder | 6.7 | 4.6 | 0.3 | 50 | 3 | 39 | 2700 |
| Examples 3-3 | remainder | 6.7 | 4.6 | 3 | 50 | 3 | 41 | 2600 |
| Comparative Examples 3-2 | remainder | 6.7 | 4.6 | 0 | 50 | 5 | 28 | 3000 |
| Examples 3-4 | remainder | 6.7 | 4.6 | 0.1 | 50 | 5 | 31 | 2900 |
| Examples 3-5 | remainder | 6.7 | 4.6 | 0.3 | 50 | 5 | 38 | 2550 |
| Examples 3-6 | remainder | 6.7 | 4.6 | 3 | 50 | 5 | 39 | 2400 |
| Comparative Examples 3-3 | remainder | 6.7 | 4.6 | 0 | 10 | 3 | 23 | 1020 |
| Examples 3-7 | remainder | 6.7 | 4.6 | 0.1 | 10 | 3 | 26 | 980 |
| Examples 3-8 | remainder | 6.7 | 4.6 | 0.3 | 10 | 3 | 35 | 960 |
| Examples 3-9 | remainder | 6.7 | 4.6 | 3 | 10 | 3 | 37 | 920 |
| Comparative Examples 3-4 | remainder | 6.7 | 4.6 | 0 | 10 | 5 | 20 | 980 |
| Examples 3-10 | remainder | 6.7 | 4.6 | 0.1 | 10 | 5 | 25 | 940 |
| Examples 3-11 | remainder | 6.7 | 4.6 | 0.3 | 10 | 5 | 34 | 930 |
| Examples 3-12 | remainder | 6.7 | 4.6 | 3 | 10 | 5 | 35 | 910 |
| Comparative Examples 3-5 | remainder | 6.7 | 4.6 | 0 | 1 | 3 | 14 | 460 |
| Examples 3-13 | remainder | 6.7 | 4.6 | 0.1 | 1 | 3 | 16 | 420 |
| Examples 3-14 | remainder | 6.7 | 4.6 | 0.3 | 1 | 3 | 22 | 380 |
| Examples 3-15 | remainder | 6.7 | 4.6 | 3 | 1 | 3 | 24 | 360 |
| Comparative Examples 3-6 | remainder | 6.7 | 4.6 | 0 | 1 | 5 | 11 | 880 |
| Examples 3-16 | remainder | 6.7 | 4.6 | 0.1 | 1 | 5 | 15 | 400 |
| Examples 3-17 | remainder | 6.7 | 4.6 | 0.3 | 1 | 5 | 21 | 380 |
| Examples 3-18 | remainder | 6.7 | 4.6 | 3 | 1 | 5 | 24 | 370 |

TABLE 3 (B)

| | | basic component (at %) | | | additive (wt %) | size of particle | quantity resin | magnetic | core loss |
|---|---|---|---|---|---|---|---|---|---|
| | | Fe | Si | Cr | Nb | (μm) | (wt %) | permeability | (kw/m$^3$) |
| Comparative Examples | 3-7 | remainder | 8.9 | 1.8 | 0 | 50 | 3 | 38 | 3900 |
| Examples | 3-19 | remainder | 8.9 | 1.8 | 0.1 | 50 | 3 | 40 | 3760 |

TABLE 3 (B)-continued

| | | basic component (at %) | | | additive (wt %) | size of particle | quantity resin | magnetic | core loss |
|---|---|---|---|---|---|---|---|---|---|
| | | Fe | Si | Cr | Nb | (μm) | (wt %) | permeability | (kw/m$^3$) |
| Examples | 3-20 | remainder | 8.9 | 1.8 | 0.3 | 50 | 3 | 48 | 3600 |
| Examples | 3-21 | remainder | 8.9 | 1.8 | 3 | 50 | 3 | 50 | 3400 |
| Comparative Examples | 3-8 | remainder | 8.9 | 1.8 | 0 | 50 | 5 | 36 | 3750 |
| Examples | 3-22 | remainder | 8.9 | 1.8 | 0.1 | 50 | 5 | 38 | 3600 |
| Examples | 3-23 | remainder | 8.9 | 1.8 | 0.3 | 50 | 5 | 47 | 3400 |
| Examples | 3-24 | remainder | 8.9 | 1.8 | 3 | 50 | 5 | 48 | 3200 |
| Comparative Examples | 3-9 | remainder | 8.9 | 1.8 | 0 | 10 | 3 | 31 | 1780 |
| Examples | 3-25 | remainder | 8.9 | 1.8 | 0.1 | 10 | 3 | 34 | 1700 |
| Examples | 3-26 | remainder | 8.9 | 1.8 | 0.3 | 10 | 3 | 39 | 1680 |
| Examples | 3-27 | remainder | 8.9 | 1.8 | 3 | 10 | 3 | 40 | 1650 |
| Comparative Examples | 3-10 | remainder | 8.9 | 1.8 | 0 | 10 | 5 | 29 | 1760 |
| Examples | 3-28 | remainder | 8.9 | 1.8 | 0.1 | 10 | 5 | 32 | 1640 |
| Examples | 3-29 | remainder | 8.9 | 1.8 | 0.3 | 10 | 5 | 38 | 1600 |
| Examples | 3-30 | remainder | 8.9 | 1.8 | 3 | 10 | 5 | 39 | 1600 |
| Comparative Examples | 3-11 | remainder | 8.9 | 1.8 | 0 | 1 | 3 | 18 | 760 |
| Examples | 3-31 | remainder | 8.9 | 1.8 | 0.1 | 1 | 3 | 20 | 730 |
| Examples | 3-32 | remainder | 8.9 | 1.8 | 0.3 | 1 | 3 | 29 | 680 |
| Examples | 3-33 | remainder | 8.9 | 1.8 | 3 | 1 | 3 | 30 | 660 |
| Comparative Examples | 3-12 | remainder | 8.9 | 1.8 | 0 | 1 | 5 | 16 | 730 |
| Examples | 3-34 | remainder | 8.9 | 1.8 | 0.1 | 1 | 5 | 19 | 670 |
| Examples | 3-35 | remainder | 8.9 | 1.8 | 0.3 | 1 | 5 | 29 | 650 |
| Examples | 3-36 | remainder | 8.9 | 1.8 | 3 | 1 | 5 | 29 | 620 |

TABLE 4

| | basic component (at %) | | | | | | additive | size of | quantity | | |
|---|---|---|---|---|---|---|---|---|---|---|---|
| | | M | | | M' | | (at %) | particle | resin | magnetic | core loss |
| | Fe | Si | Ni | Co | Cr | Al | Nb | (μm) | (wt %) | permeability | (kw/m$^3$) |
| Comparative Examples 2-3 | remainder | 6 | — | — | — | — | 0 | 10 | 3 | 20 | 2400 |
| Comparative Examples 4-1 | remainder | — | 15 | — | — | — | 0 | 10 | 3 | 32 | 2600 |
| Comparative Examples 4-2 | remainder | — | — | 15 | — | — | 0 | 10 | 3 | 31 | 2700 |
| Examples 2-8 | remainder | 6 | — | — | — | — | 0.3 | 10 | 3 | 30 | 2000 |
| Examples 4-1 | remainder | — | 6 | — | — | — | 0.3 | 10 | 3 | 42 | 2000 |
| Examples 4-2 | remainder | — | — | 6 | — | — | 0.3 | 10 | 3 | 38 | 2200 |
| Comparative Examples 3-3 | remainder | 6.7 | — | — | 4.6 | — | 0 | 10 | 3 | 23 | 1020 |
| Examples 3-8 | remainder | 6.7 | — | — | 4.6 | — | 0.3 | 10 | 3 | 35 | 960 |
| Examples 4-3 | remainder | — | 6.7 | — | 4.6 | — | 0.3 | 10 | 3 | 29 | 9000 |
| Examples 4-4 | remainder | — | — | 6.7 | 4.6 | — | 0.3 | 10 | 3 | 32 | 9800 |
| Comparative Examples 4-3 | remainder | 15 | — | — | — | 9.9 | 0 | 10 | 3 | 18 | 920 |
| Examples 4-5 | remainder | 15 | — | — | — | 9.9 | 0.3 | 10 | 3 | 26 | 900 |

TABLE 5

| | basic component (at %) | | | additive (at %) | | | | | | size of particle | quantity resin | magnetic | core loss |
|---|---|---|---|---|---|---|---|---|---|---|---|---|---|
| | Fe | Si | Cr | Nb | V | Ta | Ti | Mo | W | (μm) | (wt %) | permeability | (kw/m$^3$) |
| Comparative Examples 1-3 | 100 | — | — | — | — | — | — | — | — | 10 | 3 | 13 | 4200 |
| Examples 1-9 | 100 | — | — | 3 | — | — | — | — | — | 10 | 3 | 25 | 4050 |
| Examples 5-1 | 100 | — | — | — | 3 | — | — | — | — | 10 | 3 | 17 | 4100 |
| Examples 5-2 | 100 | — | — | — | — | 3 | — | — | — | 10 | 3 | 16 | 4100 |
| Examples 5-3 | 100 | — | — | — | — | — | 3 | — | — | 10 | 3 | 18 | 4050 |

TABLE 5-continued

| | basic component (at %) | | | additive (at %) | | | | | | size of particle | quantity resin | magnetic | core loss |
|---|---|---|---|---|---|---|---|---|---|---|---|---|---|
| | Fe | Si | Cr | Nb | V | Ta | Ti | Mo | W | (μm) | (wt %) | permeability | (kw/m$^3$) |
| Examples 5-4 | 100 | — | — | — | — | — | — | 3 | — | 10 | 3 | 18 | 4150 |
| Examples 5-5 | 100 | — | — | — | — | — | — | — | 3 | 10 | 3 | 16 | 4100 |
| Comparative Examples 2-3 | remainder | 6 | — | — | — | — | — | — | — | 10 | 3 | 20 | 2400 |
| Examples 2-9 | remainder | 6 | — | 3 | — | — | — | — | — | 10 | 3 | 33 | 1960 |
| Examples 5-6 | remainder | 6 | — | — | 3 | — | — | — | — | 10 | 3 | 27 | 2200 |
| Examples 5-7 | remainder | 6 | — | — | — | 3 | — | — | — | 10 | 3 | 24 | 2100 |
| Examples 5-8 | remainder | 6 | — | — | — | — | 3 | — | — | 10 | 3 | 25 | 2300 |
| Examples 5-9 | remainder | 6 | — | — | — | — | — | 3 | — | 10 | 3 | 28 | 2100 |
| Examples 5-10 | remainder | 6 | — | — | — | — | — | — | 3 | 10 | 3 | 23 | 2150 |
| Comparative Examples 2-9 | remainder | 12 | — | — | — | — | — | — | — | 10 | 3 | 24 | 3200 |
| Examples 2-27 | remainder | 12 | — | 3 | — | — | — | — | — | 10 | 3 | 33 | 2000 |
| Examples 5-11 | remainder | 12 | — | — | 3 | — | — | — | — | 10 | 3 | 28 | 2100 |
| Examples 5-12 | remainder | 12 | — | — | — | 3 | — | — | — | 10 | 3 | 29 | 2200 |
| Examples 5-13 | remainder | 12 | — | — | — | — | 3 | — | — | 10 | 3 | 29 | 2150 |
| Examples 5-14 | remainder | 12 | — | — | — | — | — | 3 | — | 10 | 3 | 32 | 2100 |
| Examples 5-15 | remainder | 12 | — | — | — | — | — | — | 3 | 10 | 3 | 26 | 2100 |
| Comparative Examples 3-3 | remainder | 6.7 | 4.6 | — | — | — | — | — | — | 10 | 3 | 23 | 1020 |
| Examples 3-9 | remainder | 6.7 | 4.6 | 3 | — | — | — | — | — | 10 | 3 | 37 | 920 |
| Examples 5-16 | remainder | 6.7 | 4.6 | — | 3 | — | — | — | — | 10 | 3 | 27 | 970 |
| Examples 5-17 | remainder | 6.7 | 4.6 | — | — | 3 | — | — | — | 10 | 3 | 32 | 1000 |
| Examples 5-18 | remainder | 6.7 | 4.6 | — | — | — | 3 | — | — | 10 | 3 | 33 | 1000 |
| Examples 5-19 | remainder | 6.7 | 4.6 | — | — | — | — | 3 | — | 10 | 3 | 35 | 1020 |
| Examples 5-20 | remainder | 6.7 | 4.6 | — | — | — | — | — | 3 | 10 | 3 | 28 | 980 |

The present application is based on Japanese Patent Application No. 2010-131667, filed Jun. 9, 2010, which is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as," etc.) provided herein, is intended merely to better illuminate the invention and does not pose a limitation on the scope of the invention unless otherwise claimed.

SYMBOLS

1. melting furnace
2. induction heating coil
4. raw material for melting
5. orifice
6. nozzle for atomizing
10. pressed powder magnetic core

The invention claimed is:

1. A crytalline Fe-based soft magnetic powder having a basic composition expressed by a compositional formula $Fe_{100-x-y}$ $Si_x$ $Cr_y$, wherein x is 2-10 at %; y is 2-10 at %; and x+y is 4-15 at %, wherein an oxide layer is not formed on the crystalline Fe-based soft magnetic powder, wherein a trace component that modifies magnetic property, which component is at least one transition metal selected from groups IV-VI, is included in the composition in an amount of from 0.05-4.0 weight parts based on 100 weight parts of the entire composition expressed by the compositional formula, and wherein the trace component that modifies magnetic property is added to improve magnetic properties.

2. A crystalline Fe-based soft magnetic powder having a composition expressed by a compositional formula $Fe_{100-x-y}$ $Si_x$ $Cr_y$, $N_Z$, where N is a trace component that modifies magnetic property, wherein an oxide layer is not formed on the crystalline Fe-based soft magnetic powder, wherein the trace component that modifies magnetic property is at least one transition metal selected from groups IV-VI, and wherein x is 2-10 at %; y is 2-10 at %; and x+y is 4-15 at%, and z is 0.015-2.4 at %, and wherein the trace component that modifies magnetic property is added to improve magnetic properties.

3. The Fe-based soft magnetic powder of claim 1 or 2, wherein the trace component that modifies magnetic property is at least one element selected from the group consisting of Nb, V, Ta, Ti, Mo, and W.

4. The Fe-based soft magnetic powder of claim 1 or 2, wherein the trace component that modifies magnetic property is Nb.

5. The Fe-based soft magnetic powder of claim 1 or 2, wherein the particles of the powder have an average diameter of 0.5-100 μm.

6. The Fe-based soft magnetic powder of claim 1 or 2, wherein the powder has a spherical shape.

7. The Fe-based soft magnetic powder of claim 1 or 2, wherein the powder is manufactured by a water-atomizing process.

8. A pressed powder magnetic core that is formed from a composition comprising the soft magnetic powder of claim 1 or 2 and binder(s), wherein 100 weight parts of the soft magnetic powder is mixed with 1-10 weight parts of the binder.

* * * * *